US006135637A

United States Patent [19]

Kim

[11] Patent Number: 6,135,637

[45] Date of Patent: Oct. 24, 2000

[54] COMPRESSIBLE DISPOSAL TRASH SACK

[75] Inventor: Daniel S. Y. Kim, 215 DuBois Ct., Vancouver, Wash. 98661

[73] Assignee: Daniel S. Y. Kim, Vancouver, Wash.

[21] Appl. No.: 09/449,988

[22] Filed: Nov. 26, 1999

[51] Int. Cl.[7] ..... B65D 33/01

[52] U.S. Cl. ..... 383/103; 383/903

[58] Field of Search ..... 383/103, 2, 118, 383/903

[56] References Cited

U.S. PATENT DOCUMENTS

| | | | |
|---|---|---|---|
| 3,432,087 | 3/1969 | Costello | 383/103 |
| 4,978,231 | 12/1990 | Ling | 383/103 X |
| 5,213,141 | 5/1993 | Dorman | 383/103 X |

FOREIGN PATENT DOCUMENTS

| | | | |
|---|---|---|---|
| 2614899 | 10/1977 | Germany | 383/103 |
| 2802849 | 7/1978 | Germany | 383/103 |

*Primary Examiner*—Jes F. Pascua

[57] ABSTRACT

A plastic trash sack having series of vertical air slots made up of fine perforations on upper portions of both sack walls that break open from stress of compression to allow excess air inside sack to discharge to outside atmosphere. The discharge of air facilitates sack to compact upon its self and flexible trash contents within, further minimizing sack volume and continually maximizing receptacle holding capacity for the duration which compression is generated by weight of other sacks or applied by persons.

7 Claims, 2 Drawing Sheets

COMPRESSIBLE DISPOSAL TRASH SACK

BACKGROUND OF THE INVENTION

This invention relates to disposable trash sacks, specifically to a method and an improved trash sack with air slots to reduce sack volume by discharging air, permitting compression of trash contents.

The improved trash sack of this invention responds to the long standing and troublesome inconvenience of air being trapped in conventional disposable trash sacks in a ballooning effect when tied to seal. Most conventional trash sacks are made of flexible, plastic sheet material that when open ends are gathered and tied to securely seal in trash also seal in air. Analogous to pushing on an inflated balloon with intent to crush paper cups inside; an excess of trapped air within a sealed trash sack inhibits sack and contents to yield to applied forces of compression with intent to compact. In addition, unlikely is successful compression and compacting of trash contents in a sealed air swelled sack while maintaining integrity of sack seal, and avoiding breach of sack walls and edges by rips and tears.

Time and effort taken to manually push air out of full trash sacks while trying to minimize contents is cumbersome and messy. Common practice to remedy ballooning effect of full and sealed conventional sack is to unseal. Then follow up by compressing trash content to push out pocketed air while simultaneously sack walls and edges are gathered tautly with strict proximity to trash to prevent readmission of air and decompression of content upon reseal. Most people do not want nor have time to hassle with the discharge of air and compression of content of each sack before disposal. As result, most trash sacks are disposed in receptacles fat with air wasting with each added sack volumes of receptacle space.

Most sanitation services gage pick-up and disposal fees by amount of trash in volume not weight. Thus any wasteful take up of valued space in multiple-sack disposal receptacles by sacks bulged with air creates an extra disposal cost for the business and private sector. Therefore, a need remains for an air discharging trash sack, which facilitates a simple, low force, and inexpensive way to minimize sack volume in order to achieve optimum economy of available capacity in disposal receptacles.

SUMMARY OF THE INVENTION

The purpose of this invention is to discharge excess air trapped within disposable plastic sack when tied to seal; and to provide a method to facilitate a reduction in sack volume by a compression of trash contents actuated by weight of other sacks to maximize holding capacity in receptacles.

The improved sack has columns of discrete groups of successive uniform perforations that span across the upper portion of both walls of sack. The perforations can be expressed uniformly in either of two forms:

a) One type of perforation group is a vertically aligned sequence of small, close following slits.

b) Second type of perforation group is a vertically aligned sequence of small, close set circular holes. These sequences of perforations are seam-like. When split apart along seam release open to form air slots. The air slots are means for discharging air from the sack to facilitate a compacting of contents to reduce sack volume.

For discharging superfluous air trapped within improved sack, an initial commensurable compressive force is exerted upon the sealed trash sack either by manual power or from the substantial weight from above or adjacent like sacks in disposal receptacle. The compressive forces enacting upon the sealed sack displaces air inside against the walls of the sack. The increase of pressure and building tension against sack walls stretch the area of perforations that circumscribe the upper area of the sack. Eventually the perforated material yields and the seam-like sequence of perforations pull apart opening as air slots. The air slots may be activated and air discharged:

a) prior to seal and sack disposal as a way to compress any flexible materials intermittently while it is being filled to capacity b) after sack is sealed but before disposal in preparation for content compression for when deposited in receptacle c) after sack is sealed and deposited in disposal receptacle for like sacks deposited on top to provide the commensurable weight for compression so perforations can split open The intended aperture of air slots extend substantially open to accommodate sufficient air discharge, yet conservative enough as to prevent the passing of trash stuffs. Since air slots are restricted to the upper portion of the sack walls any liquids expelled by wet trash can matriculate and reservoir at the bottom of the sack. It is the design of the improved trash sack to accommodate both dry and wet refuse.

The method for reducing sack content volume to maximize multiple sack receptacles holding capacity incorporates the available means of the improved trash sack with force of weight actuated by other full and sealed sacks. With increasing number of sacks added upon existing sacks in receptacle, the force of weight will by an accumulative fashion subject constant and increasing compressive force to activate air discharging slots and compact of trash content. The sacks bearing more burden of the weight receive more force of compression to facilitate optimum reduction of sack volume. The discharged air eliminates any air cushions around trash within the sack allowing applied forces to effectively compact any flexible trash materials to further minimize sack volume thus maximize the available vacancy to admit trash in receptacle.

The advantage of the improved sack eliminates the messy, bothersome, and time-consuming chore of pushing excess air out while trying to close the sack. Just seal the sack, push down to release air and dispose, or just seal, dispose, and the weight of sacks will do the work. This invention and method can reduce the cost of disposal service fees for the private and business sector by enabling more refuse to be disposed in receptacle at one time.

Another advantage of this invention is the increased ventilation provided by air slots, which accelerate the process of natural decomposition. The increased circulation and exposure to air inside the sacks renders the trash contents within to succumb more to quickly to oxidation and breakdown when discarded in landfills.

The invention will be better understood and additional features and advantages will become evident through the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
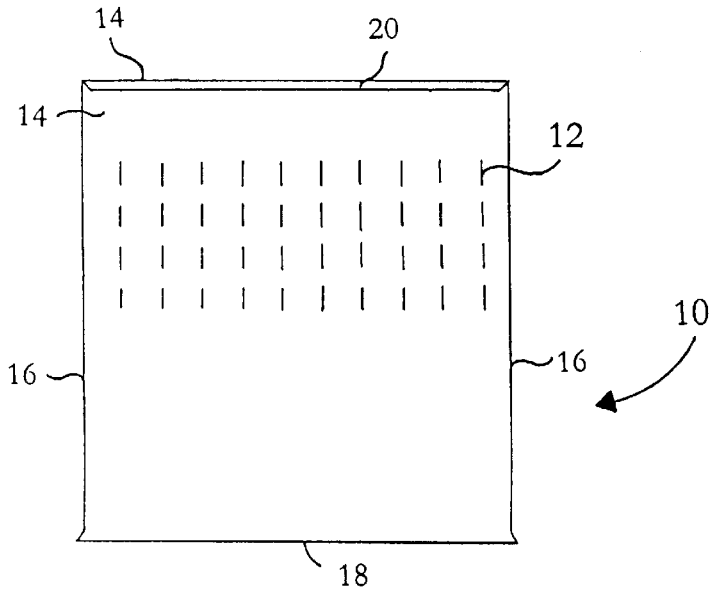
FIG. 1 is a front elevation view of the improved trash sack embodying the invention without contents.

Referring now to FIG. 1, an improved trash sack according to the present invention as shown by 10. Trash sack 10 comprises of two sheets of flexible sheet material in a symmetrical disposed relationship 14. Sheets 14 are joined to seal at side edges 16 and a closed sealed bottom end 18 leaving open top 20. Air slots prior to initiation are discrete groups of vertically sequenced uniform perforations 12 spanned in longitudinally spaced columns across from side seal to seal 16 on the upper portions of both lateral sheet walls 14. The top most perforation groups among columns are sufficiently distanced down from open top edges of sack to allow a horizontal margin of non-perforated material to be gathered for tie and seal.

Figure 2:
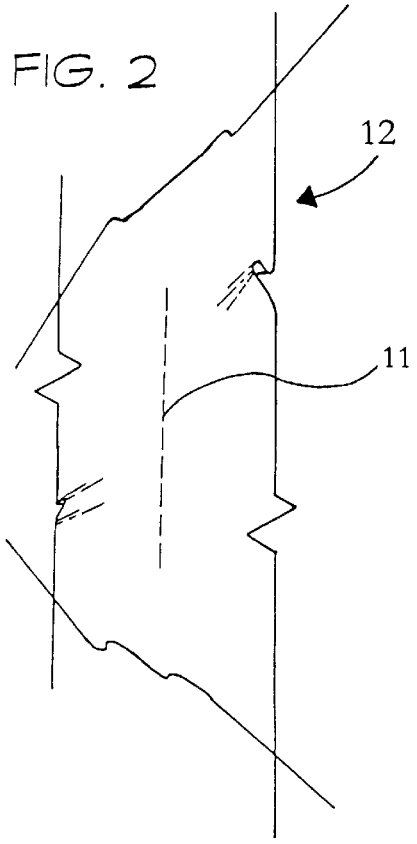
FIG. 2 is an enlarged perspective view of an unreleased perforation of the slit type FIG. 1.
Figure 3:
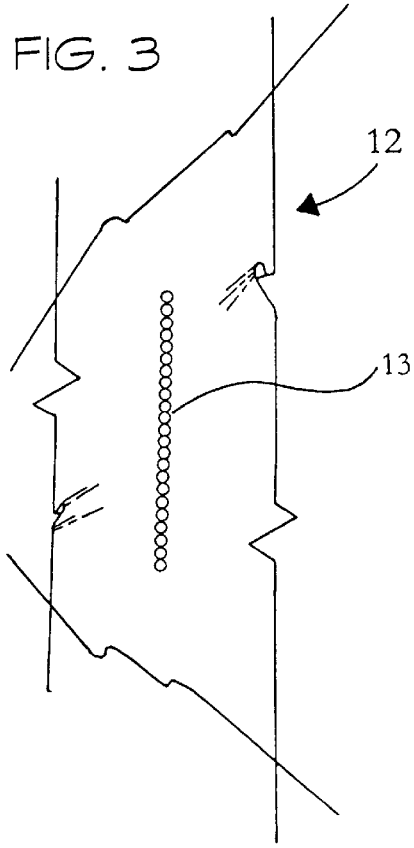
FIG. 3 is an enlarged perspective view of an unreleased alternative perforation of the circular puncture type FIG. 1.

In FIG. 2, the slit option for perforation groups 12 is illustrated. A plurality of aligned, narrow, vertical slits 11 substantially uniform in length are cut so to penetrate plastic sheet material of lateral walls 14 allowing minimal spacing between each slit end. In FIG. 3, the circular puncture option for perforation groups 12 is illustrated. It shows the same vertical alignment with a plurality of uniformly sized small, circular, contiguous punctures 13.

Figure 4:
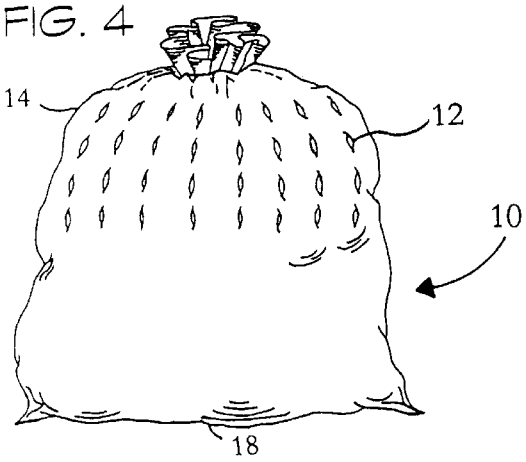
FIG. 4 is a front perspective view of the improved trash sack embodying the invention FIG. 1 with full of trash activating air slots due to compressive force.
Figure 5:
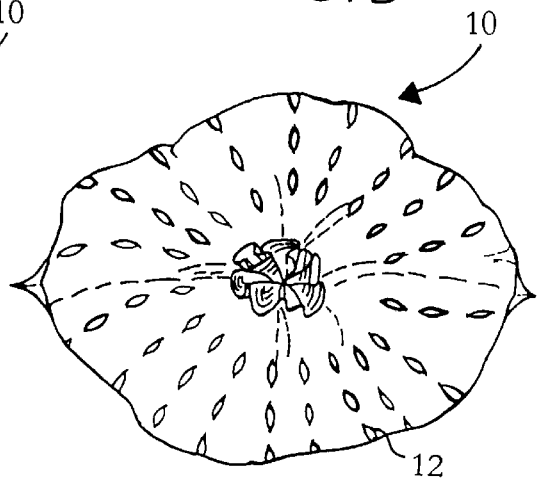
FIG. 5 is a top plan view of the trash sack in FIG. 4.
Figure 6:
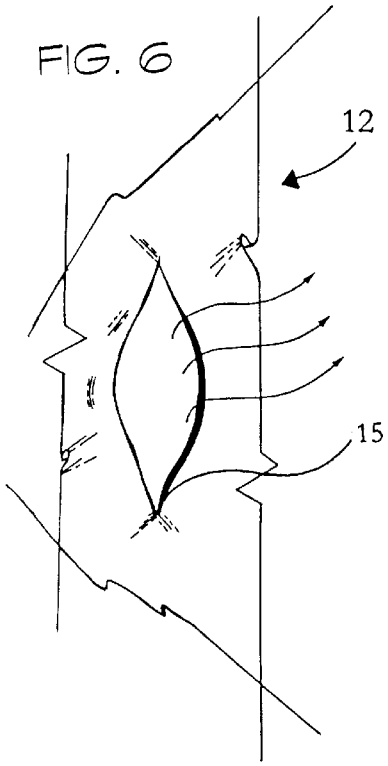
FIG. 6 is an enlarged perspective view of perforation FIGS. 2 and 3, released and activated as an air slot discharging air from sack due to compressive force FIGS. 4 and 5.

In FIG. 4, the improved trash sack 10 is shown sealed and full of contents with perforation groups of each column split open activating air slots 12 for discharging air. In FIG. 5, from a view above, show the columns of air slots in design to circumference when sack is full of contents. A perforation group 12 initiated as an animated air slot 15 is illustrated in FIG. 6. As seen in FIGS. 4 and 5, the air slot 15 is open to intended aperture and discharging air due to applied force of compression upon trash sack 10.

Figure 7:
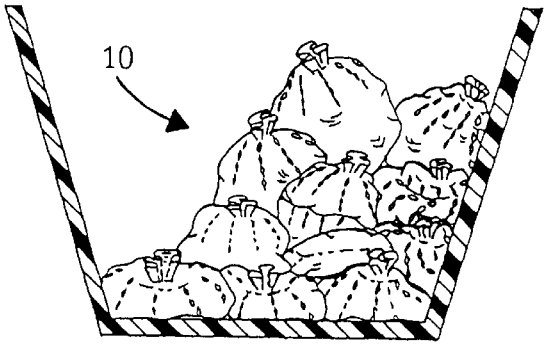
FIG. 7 is a perspective view of multiple trash sacks embodying the invention as FIGS. 4 and 5 showing sacks compressing under the force of weight from said sacks above and adjacent in a disposal receptacle.

In FIG. 7, illustrated by a cross-sectional view of a large capacity trash receptacle containing multiple improved trash sacks 10, is optimization of receptacle holding space according to method of present invention. The compression actuated by weight of sacks compacts with more force those sacks most towards the bottom of receptacle bearing the full stress of weight.

What is claimed is:

1. A trash sack with air slots comprising:

a) a sack formed from flexible plastic sheet material with closed bottom end, lateral walls, and open defining top edge, b) weakened linear discrete portions of the wall made up of fine perforations, aligned in plurality of longitudinally spaced columns span across width of said walls, the air slots being constructed so when air pressure on the inner side of the walls exceeds the atmosphere pressure on the outer side of the walls, the perforations that make up the weakened portions of the walls will rupture thus opening and allowing air to discharge through the air slots.

2. A trash sack according to claim 1, wherein "said sack has weakened linear discrete portions aligned in a plurality of longitudinally spaced columns that span across upper area of the walls."

3. A trash sack according to claim 1, wherein "said air slots comprise of fine slit perforations."

4. A trash sack according to claim 1, wherein "said air slots comprise of fine contiguous circular puncture perforations."

5. A method for compressing air from trash sack comprising the steps of:

providing a trash sack of flexible plastic sheet material having closed bottom end, lateral walls; and open top defining top edge of both the lateral walls including plurality of longitudinally spaced columns of weakened linear discrete portions made up of fine perforations spanning across upper width of the walls;

providing either fine vertical slit or contiguous circular puncture form as said perforations, filling said sack substantially full of trash contents then tying to seal, enacting sufficient compressive force on said sack so that increasing air pressure puts internal stress against the walls of said sack intensifying tension so that stretching of thin bonds of material between the perforations weaken, eventually causing material to yield and weakened portions comprising of the perforations release open to intended aperture and form air slots which under sufficient forces of compression discharge air to external atmosphere.

6. A trash sack according to claim 1, wherein said sack has horizontal margin, extending from the closed bottom end of said sack to the bottom ends of the columns, void of weakened portions.

7. A trash sack according to claim 1, wherein the weakened linear discrete portions are aligned vertical.

* * * * *